US008785095B2

(12) United States Patent
Yoon et al.

(10) Patent No.: US 8,785,095 B2
(45) Date of Patent: Jul. 22, 2014

(54) TONER FOR DEVELOPING ELECTROSTATIC CHARGE IMAGE, AND APPARATUS AND METHOD FOR FORMING IMAGE USING THE SAME

(75) Inventors: Se-young Yoon, Hwaseong-Si (KR); Song-won Hyun, Yongin-si (KR); Hong-Chul Shin, Suwon-si (KR); Sung-dong Lee, Suwon-si (KR); Jong-in Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/326,994

(22) Filed: Dec. 15, 2011

(65) Prior Publication Data

US 2012/0171602 A1 Jul. 5, 2012

(30) Foreign Application Priority Data

Dec. 29, 2010 (KR) ..... 10-2010-0138037

(51) Int. Cl.
*G03G 9/00* (2006.01)

(52) U.S. Cl.
USPC ..... 430/108.6; 430/108.1; 430/108.7

(58) Field of Classification Search
USPC ..... 430/108.1, 108.6, 108.7
See application file for complete search history.

(56) References Cited

U.S. PATENT DOCUMENTS

| | | | | |
|---|---|---|---|---|
| 6,555,282 | B2 * | 4/2003 | Okuno et al. | 430/108.6 |
| 6,613,491 | B2 * | 9/2003 | Inoue et al. | 430/110.3 |
| 2010/0159380 | A1 * | 6/2010 | Ishigami et al. | 430/108.7 |
| 2010/0261109 | A1 * | 10/2010 | Okada et al. | 430/105 |
| 2010/0261112 | A1 * | 10/2010 | Aruga et al. | 430/105 |
| 2010/0261113 | A1 * | 10/2010 | Aruga et al. | 430/105 |

FOREIGN PATENT DOCUMENTS

JP 2010-128216 6/2010

* cited by examiner

*Primary Examiner* — Stewart Fraser
(74) *Attorney, Agent, or Firm* — Stanzione & Kim, LLP

(57) ABSTRACT

Disclosed is a toner for developing an electrostatic charge image, including a toner particle coated with a combination of sol-gel silica particles, hydrophobically surface-treated fumed silica particles, and hydrophobically surface-treated titanium dioxide particles.

10 Claims, 2 Drawing Sheets

TONER FOR DEVELOPING ELECTROSTATIC CHARGE IMAGE, AND APPARATUS AND METHOD FOR FORMING IMAGE USING THE SAME

CROSS-REFERENCE TO RELATED APPLICATIONS

This application claims the benefit of Korean Patent Application No. 10-2010-0138037, filed on Dec. 29, 2010, in the Korean Intellectual Property Office, the disclosure of which is incorporated herein in its entirety by reference.

BACKGROUND OF THE INVENTION

1. Field of the Invention

The present general inventive concept relates to a toner for developing an electrostatic charge image used for development of an electrostatic latent image, and an apparatus and method for forming the image using the same.

2. Description of the Related Art

Toner particles suitable for use in an electrophotographic process and an electrostatic image recording process may be largely classified into toner particles prepared by using a pulverization method and toner particles prepared by using a polymerization method.

For toners manufactured by pulverization, there is a wide selection of resins available for use, and a desired toner may be relatively easily manufactured. However, because it is difficult to precisely control the particle size and particle size distribution of toner particles and the toner structure, the particle shape is irregular, and the particle size distribution is wide, major properties required for a toner, such as chargeability, transferability, fixability, developability, fluidity, fine dot reproducibility, storability, etc., are poor, and it is difficult to independently design these properties. In addition, image defects, such as streaking, image contamination, deterioration of fixing properties such as offset, and reduction in gloss, may occur. As a result, manufacturing such toners generally includes multiple processes, high energy consumption, and high costs.

Recently, research has been conducted into a method of developing a polymerized toner, whereby the particle diameter is easily controllable and which does not require a complex manufacturing process, such as size classification. When a toner is manufactured by using this polymerization method, a polymerized toner having a desired particle size and particle size distribution may be obtained, without pulverizing or size classification. Since a polymerized toner has a smaller particle diameter and a narrower particle size distribution, as compared to a toner manufactured by a pulverization method, the polymerized toner is advantageous in that it has high chargeability, transferability, and charge stability, good dot and line reproducibility, low toner consumption, and high image quality. In particular, the polymerization method provides the ability to control the shape of toner particles, which may range from an almost perfectly spherical to potato-shaped.

A toner with spherical particles may be transferred to paper with uniform thickness and concentration, and has a low incidence of toner reverse polarity. However, spherical toner particles are difficult to clean. To compensate for this cleanability deficiency, toners with potato-shaped particles are typically used.

In particular, to accommodate modern tendencies for miniaturization, low price realization, and environmental concerns, while providing for full-colorization, high speed, and high quality images in a printer, a toner shape and surface control technology to satisfy the properties of a toner is becoming increasingly important. For example, the frequency of shear strain imposed on a toner has increased due to higher speed operations. Therefore, a high-durability toner is needed, and toner surface treatment technology is needed to enhance the charging uniformity and transfer efficiency of a toner, in order to reduce the amount of residual toner not transferred during the transfer process.

Recently, tandem-mode development methods have been widely used, due to the higher speeds of printers and copying machines. In order to obtain a high quality image using tandem-mode development methods, high charge stability, transfer efficiency, and cleanability, are needed. In order to enhance charge stability, transfer efficiency, and cleanability, the selection of an additive for treating toner particle surfaces is important. Additives confer fluidity to resin particles, to improve toner supplying ability, and adhere to toner particle surfaces to confer stable charging performance. In addition, additives reduce the surface adhesion of an electrostatic latent image bearing member, to greatly influence toner cleanability.

However, it is difficult to stably secure all the above qualities using conventional inorganic particles as surface treatment agents. In particular, when a toner with a small average particle diameter is used for high image quality applications, it difficult to achieve sufficient performance using a conventional inorganic additive. As the toner particle diameter decreases, toner fluidity is reduced. Accordingly, a large amount of inorganic external additive is generally used. However, these inorganic additives tend to be easily liberated from toner surfaces or may be embedded in toner surfaces, due to stress caused by friction between a toner supply roller and a cleaning blade, agitation in a developing machine, etc. When an external additive is liberated or embedded, the fluidity of toner particles is reduced, resulting in a reduction in the ability to supply toner and an increase of adhesion to the developing roller, leading to a rapid reduction in developability and durability.

SUMMARY OF THE INVENTION

The present general inventive concept provides a durable toner for developing an electrostatic charge image, which may be used to stably obtain a high quality image over a long period of time and particularly under high speed printing conditions.

Additional features and utilities of the present general inventive concept will be set forth in part in the description which follows and, in part, will be obvious from the description, or may be learned by practice of the general inventive concept.

Exemplary embodiments of present general inventive concept also provide an apparatus for forming an image using the toner.

Exemplary embodiments of present general inventive concept also provide a method of forming an image using the toner.

According to various embodiments of the present disclosure, provided is a toner including: a toner particle including a binder resin, a colorant, and a releasing agent; and an external additive attached to the surface of the toner particle, the external additive including silica particles combined by a sol-gel method (sol-gel silica particles), hydrophobically surface-treated fumed silica particles, and hydrophobically surface-treated titanium dioxide particles.

The external additive may include about 0.1 parts by weight to about 3 parts by weight of the sol-gel silica particles, about 0.1 parts by weight to about 2 parts by weight of the fumed silica particles, and about 0.1 parts by weight to about 2 parts by weight of the titanium dioxide particles, based on 100 parts by weight of the toner particle.

An average sphericity value (ratio of the shortest diameter/longest diameter) of the sol-gel silica particles may be in a range of about 0.8 to about 0.97.

A ratio of the number of sol-gel silica particles having a sphericity value of less than about 0.97 to the total number of the sol-gel silica particles may be in a range of about 50% or more.

A volume average particle size distribution value of the sol-gel silica particles, $(D84v/D16v)^{1/2}$, may be in a range of about 1.7 to about 2.3, where each of the D16v and D84v respectively indicates a particle diameter at which a cumulative percentage of 16% is attained and a particle diameter at which a cumulative percentage of 84% is attained, in a cumulative distribution of volume of silica particles measured by the Coulter method.

The sol-gel silica particles may have a BET specific surface area in a range of from about 30 $m^2/g$ to about 70 $m^2/g$, an average primary particle diameter in a range of from about 10 nm to about 80 nm, and a degree of hydrophobicity of less than about 50.

The sol-gel silica particles may have a true specific gravity in a range of about 1.5 or more to less than about 2.5.

The sphericity and average particle diameter of the sol-gel silica particles are calculated by measuring the longest diameters, the shortest diameters and the average particle diameters from 100 of the sol-gel silica particles when the sol-gel silica particles are magnified at 50,000× or more to less than 100,000× and observed by scanning electron microscopy (SEM) at room temperature and under relative humidity (RH) of 55±5%.

The toner particles may be prepared by a pulverization method or by a polymerization method.

The hydrophobically surface-treated fumed silica particles and hydrophobically surface-treated titanium dioxide particles may have average primary particle diameters in a range of from about 7 nm to about 50 nm and about 10 nm to about 50 nm, respectively.

According to another exemplary embodiment of the present disclosure, provided is an apparatus for forming an image, including the toner for developing an electrostatic charge image, according to an aspect of the present general inventive concept.

According to another exemplary embodiment of the present disclosure, provided is a method of forming an image, including attaching a toner to a photoreceptor surface on which an electrostatic latent image is formed, to form a visible image, and transferring the visible image to a transfer member, wherein the toner is a toner according to an exemplary embodiment of the present disclosure.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings, of which.

DETAILED DESCRIPTION OF THE EXEMPLARY EMBODIMENTS

Figure 1:
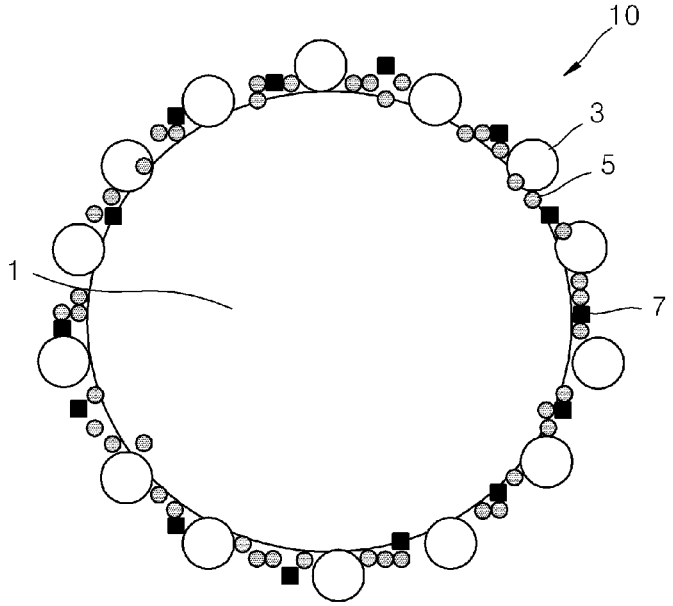
FIG. 1 is a schematic view of a toner particle for developing an electrostatic charge image, according to an exemplary embodiment of the present general inventive concept.

Reference will now be made in detail to the exemplary embodiments of the present general inventive concept, examples of which are illustrated in the accompanying drawings, wherein like reference numerals refer to the like elements throughout. The exemplary embodiments are described below, in order to explain the present general inventive concept while referring to the figures.

A toner for developing an electrostatic charge image, and an apparatus and method for forming the image, according to an exemplary embodiment of the present general inventive concept, will be described below in more detail.

FIG. 1 is a schematic view of a toner 10 for developing an electrostatic charge image, according to an exemplary embodiment of the present general inventive concept. Referring to FIG. 1, the toner 10 includes a toner particle 1 including a binder resin, a colorant, and a releasing agent; and an external additive attached to the surface of the toner particle 1. The external additive includes a combination of silica particles formed by a sol-gel method (sol-gel silica particles) 3, hydrophobically surface-treated fumed silica particles 5, and hydrophobically surface-treated titanium dioxide particles 7.

The toner particle 1 includes at least a binder resin, a colorant, and a releasing agent, and may further include an additive typically used in the art. The additive may include, for example a charge control agent, etc. The toner particle 1 may be prepared by using a polymerization method or a pulverization method. Any suitable binder resin, colorant, and releasing agent may be used. In addition, any suitable amounts of binder resin, colorant, and releasing agent may be used. For example, the toner particle 1 may be a toner particle prepared by aggregation and coalescence of a polystyrene-butylacrylate copolymer latex, a styrene-butylacrylate-acrylic acid copolymer latex, or a polyester-based latex, prepared by performing emulsion polymerization with a colorant. According to some embodiments, the toner particle 1 may be prepared by performing pulverization. Forming the toner particle 1 in a spherical shape allows for high image quality, due to its stable chargeability and excellent dot reproducibility.

The sol-gel silica particles 3 are silica particles obtained by applying a solvent removal process to a silica sol suspension produced by hydrolysis and condensation reaction of an alkoxysilane in an aqueous organic solvent in the presence of a catalyst, and a drying process. The sol-gel silica particles 3 may be prepared by using different raw materials and different processes from those of fumed silica particles prepared by using a dry method and colloidal silica particles prepared by using a wet method (precipitation method), and also provide different image characteristics when attached to the surface of a toner particle. The average sphericity value (ratio of the shortest diameter to the longest diameter) of the sol-gel silica particles 3 may be in a range of from about 0.8 to about 0.97. The closer the sphericity value is to 1, the closer to a perfect sphere the shape is. As it can be seen from the low sphericity value, sol-gel silica particles 3 deviate more from a perfect spherical shape when compared to sol-gel silica particles conventionally used as an external additive. The closer the sphericity value is to 1, the more difficult it is to clean toner remaining on a photoreceptor, which may result in contamination of a charge roller and a filming phenomenon occurring on a photoreceptor. As such, the sol-gel silica particles 3 are generally configured to have a low sphericity value.

A ratio of the number of sol-gel silica particles 3 having a sphericity value in a range of less than about 0.97 to the total number of the sol-gel silica particles 3 may be in a range about 50% or more. The sol-gel silica particles 3 may have a volume average particle size distribution $(D84v/D16v)^{1/2}$ value in a range of about 1.7 to about 2.3. D16v and D84v respectively indicate a particle diameter at which a cumulative percentage of 16% is attained and a particle diameter at which a cumulative percentage of 84% is attained, in a cumulative distribution of volume of silica particles measured by using a Coulter method. When the sol-gel silica particles 3 have a wider particle size distribution than that of conventional sol-gel silica particles, the sol-gel particles 3 may be relatively uniformly attached to the surface of a toner particle, thus enhancing charge uniformity.

The sol-gel silica particles 3 may have a BET specific surface area in a range of from about 30 $m^2/g$ to about 70 $m^2/g$, an average primary particle size in a range of from about 10 nm to about 80 nm, and a degree of hydrophobicity of less than about 50. The BET specific surface area of the sol-gel silica particles 3 is measured by the multipoint BET nitrogen adsorption method according to ASTM D-1993-03.

According to some embodiments, the average primary particle diameter of the sol-gel silica particles 3 may be in a range of from about 30 nm to less about 80 nm, or from about 60 nm to about 80 nm. When the average primary particle diameter is about 80 nm or more, it may become difficult for the toner particles to pass through a developing blade. Thus, the selection phenomenon of the toner particles may increase. Therefore, as the toner approaches the latter part of its service life, the diameters of the toner particles becomes larger. Accordingly, the charge amount is decreased, and the toner layer is apt to become thicker. In addition, when the size is about 80 nm or more, the sol-gel silica particles may be more easily removed from the toner particles, due to stress caused by members such as a supply roller, etc. In such a case, the free external additive may contaminate charge members or latent image bearing members, etc.

When the size sol-gel silica particles is less than about 30 nm, the silica particles are apt to be embedded in the surface of the toner, due to a shearing force of a developing blade, which increases the physical adhesive force therebetween. Accordingly, developability and transferability tend to be reduced. The sol-gel silica particles 3 may improve the performance of the external additive by reducing the adhesive force of the toner 1 on the surface of the development member and transfer member and thereby enhance the efficiencies of development and transfer processes. The sol-gel silica particles 3 may also improve the durability of the toner 1 by preventing the liberation and embodiment of the fumed silica particles 5 having a small average particle diameter.

The degree of hydrophobicity refers to a value measured by using a conventional methanol titration method. For example, the degree of hydrophobicity may be measured as follows. 0.2 g of silica particles are added to 100 ml of ion exchange water disposed in a glass beaker having an internal diameter of 7 cm, and the resultant is stirred with a magnetic stirrer. The tip of a burette containing methanol is immersed in the resultant suspension, while 20 ml of methanol is dripped therein. The stirring is stopped after about 30 seconds, and the state 1 minute after stopping the stirring is observed. This operation is repeatedly performed. When the silica particles do not float on the water 1 minute after stopping the stirring, the total added amount of methanol is taken as Y (ml), and a value obtained by the following formula is calculated as the degree of hydrophobicity. The water temperature in the beaker is adjusted to about 20° C.±1° C. to perform the measurement. The degree of hydrophobicity=[Y/(100+Y)×100].

The sol-gel silica particles 3 having such a specific hydrophobicity may have enhanced wear resistance, charge stability according to changes in environment, etc. The sol-gel silica particles 3 may have a true specific gravity in a range of from about 1.5 to about 2.5. When the specific gravity of the sol-gel silica particles 3 deviates from this range, the added amount is increased. As a result, contamination may occur.

The sphericity and average particle diameter of the sol-gel silica particles 3 are calculated from the measurement of the shortest and longest diameters and the average particle diameters from 100 of the sol-gel silica particles 3. In particular, the sol-gel silica particles 3 are magnified at from about 50,000× to about 100,000× using scanning electron microscopy (SEM), at room temperature, and under a relative humidity (RH) of 55±5%.

According to various embodiments, the toner 10 includes the hydrophobically surface-treated fumed silica particles 5 and the hydrophobically surface-treated titanium dioxide particles 7, in addition to the sol-gel silica particles 3. The hydrophobically surface-treated fumed silica particles 5 and hydrophobically surface-treated titanium dioxide particles 7 have an average primary particle size in a range of about 7 nm to about 50 nm and about 10 nm to about 50 nm, respectively, indicating that they have average particle diameters smaller than that the sol-gel silica particles 3.

In the toner 10, the two types of silica particles 3 and 5, which have different average particle diameters, are included as additives. When only the smaller silica particles 5 are included, charge stability is increased. However, the silica particles 5 are apt to be embedded into the toner particle 1. When only the larger silica particles 3 are included, the porosity of the silica particles 3 reduces the charge stability thereof, such that the particles 3 are apt to be liberated from the toner particles 1. However, the silica particles 5 fill the gaps between the silica particles 3. As a result, the charge stability is increased and the silica particles 5 are prevented from being embedded in the toner particles 1. In this case, even when the printing is continuously conducted for a long time, toner fluidity may be maintained, which results in enhanced image maintenance.

According to various embodiments, the fumed silica particles 5 are configured to have good dispersibility. Silica particles are apt to be aggregated by surface treatment. This aggregation reduces the surface area of an external additive to decrease the amount of external additive attached to the surface of toner particles. Therefore, the fumed silica particles 5 are configured to have a relatively low degree of aggregation to improve dispersibility. As a result, fluidity and charge stability of the toner 10 may be enhanced. The dispersibility of the fumed silica particles 5 may be evaluated by measuring the particle size distribution of the fumed silica particles 5 using a particle size analyzer. The aggregates (secondary particles) of general silica particles show a particle size distribution close to a unimodal form. On the other hand, in the case of the aggregates (secondary particles) of the fumed silica particles 5, the aggregated fumed silica particles 5 have an average size in a range of about 5 μm to about 20 μm and a bimodal-type particle size distribution with two peaks at about 1 μm or less and about 5 μm or more, to reduce the number of gaps between the external additives. As a result, charge stability may be enhanced.

The fumed silica particles 5 may be surface-treated with silicone oil at from about 0.05 wt % to about 2 wt % and may have a BET specific surface area of about 70 $m^2/g$ or less. In the alternative, the fumed silica particles 5 may be surface-treated with a silane coupling agent at from about 0.05 wt % to about 2 wt % and may have a BET specific surface area of about 150 $m^2/g$ or more. The hydrophobically surface-treated titanium dioxide particles 7 may include rutile-type titanium dioxide particles surface-treated with silicone oil and having a BET surface area of about 100 $m^2/g$ or more, and may have a degree of hydrophobicity of about 50 or more.

The silica particles 3 and 5 increase the charge amount and the fluidity of the toner 10, while the titanium dioxide particles 7, which have a relatively low electrical resistance and excellent charge exchangeability, narrow the charge distribution and decrease the amount of reverse polarity of the toner 10. Titanium dioxide may be an anatase-type or a rutile-type. According to various embodiments, the titanium dioxide particles may include the rutile-type titanium dioxide, which exhibits a relatively narrow charge distribution and allows the photoreceptor to be easily cleaned.

In addition, the above-mentioned silica particles 3 and 5 enhance the environmental stability of the toner 10 under high temperature-high humidity and low temperature-low humidity environments. In particular, when the density of silica particles is low under high temperature and high humidity conditions, moisture, which is highly conductive, easily penetrates into gaps of between the silica particles and becomes responsible for decreasing the charge amount. In this case, the image concentration is increased, the background contamination is severe, and the silica particles are easily desorbed, resulting in durability reduction. Accordingly, the toner 10 may include the silica particles 3 with a large average particle diameter and the silica particles 5 with a small average particle diameter, with both having an apparent density in a range of about 100 g/l to about 200 g/l.

The external additives may include about 0.1 parts by weight to about 3 parts by weight of the sol-gel silica particles 3, about 0.1 parts by weight to about 2 parts by weight of the fumed silica particles 5, and about 0.1 parts by weight to about 2 parts by weight of the titanium dioxide particles 7, based on 100 parts by weight of the toner particles. Within this content range, the characteristics of the additives may be balanced to provide the toner 10 with excellent all around characteristics.

On the other hand, for example, when only conventionally used fumed silica particles are used as an external additive, a charge-up phenomenon is apt to occur due to the strong negativity of these particles. When a combination of titanium dioxide particles and fumed silica particles is used as an external additive, as described in U.S. Pat. No. 6,555,282, in order to prevent this excessive frictional charging, the charge uniformity is adversely affected. In particular, titanium dioxide has a electrical resistance and a good charge exchangeability, so as to relatively easily produce reversely charged or weakly charged toners. When silica particles are added, the higher the porosity of the silica particles the more hydrophilic the surfaces thereof are, which increases the chargeability of negatively charged toners under low temperature and low humidity conditions.

On the other hand, moisture serves as a kind of conductor under high temperature and high humidity conditions, and the more the moisture that is absorbed, the less chargeability there is. Thus, the charge stability is reduced according to environmental changes. As a result, poor concentration reproducibility such as a rapid increase in concentration, etc, and background contamination are apt to occur under high temperature and high humidity conditions, while image stains due to electrostatic effects are apt to occur under low temperature and low humidity conditions.

In order to solve the above charge stability problems, the surfaces of silica particles or titanium dioxide particles may be treated with a hydrophobic silicone oil or a silane coupling agent. However, the aggregation of toner particles is increased by such a surface treatment, and thus, the dispersibility of the toner particles is decreased, or the blocking phenomenon is apt to occur. In particular, when fumed silica is used, the aggregation of silica particles tends to occur during the manufacturing, leading to deterioration of the particle performance. When the dispersibility of these inorganic particles is poor, the fluidity, caking resistance, and fixability is reduced and thus, the toner may be difficult to supply and/or fix.

When silica particles are aggregated, the cleanability of the toner is also reduced, leading to a filming phenomenon, whereby the silica particles are attached to an electrostatic latent image bearing member, or a charging roller may be contaminated, leading to irregular charging on the electrostatic latent image bearing member and reduced fixability. However, according to various embodiments, the toner 10 may avoid such problems, by including a combination of the hydrophobically surface-treated fumed silica particles 5, hydrophobically surface-treated titanium dioxide particles 7, and the non-surface treated silica particles 3.

An apparatus for forming an image, according to the present general inventive concept, includes the toner 10.

Figure 2:
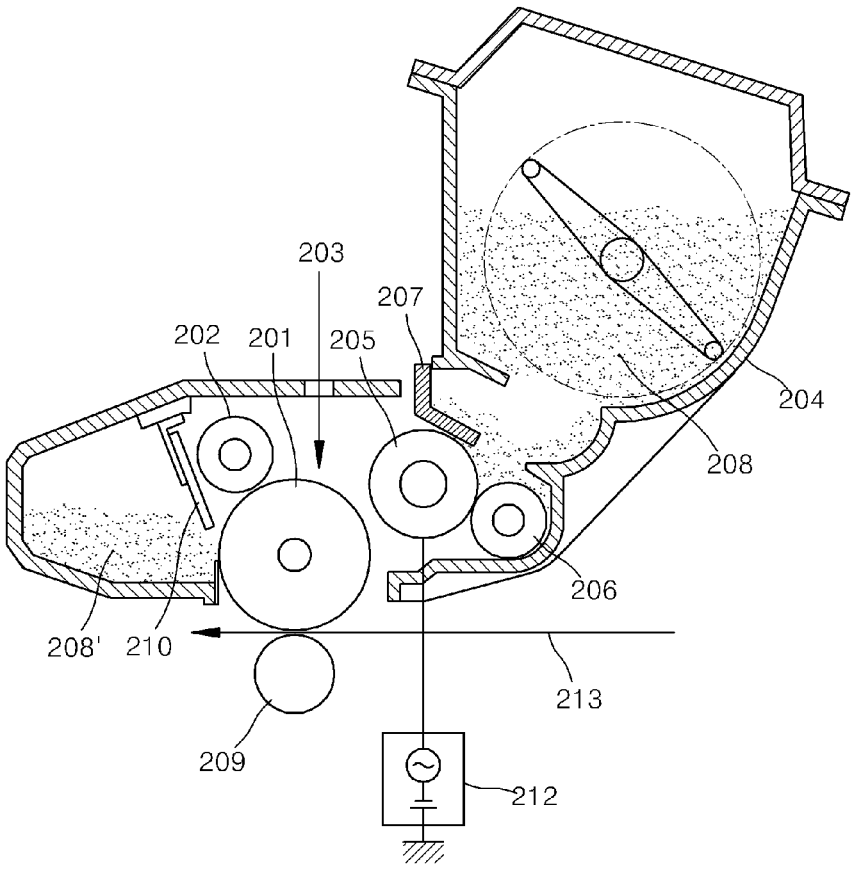
FIG. 2 is a schematic view of apparatus for forming an image according to an exemplary embodiment of the present general inventive concept.

A method of forming an image, according to the present general inventive concept, includes attaching the toner 10 to a photoreceptor surface on which an electrostatic latent image is formed, to form a visible image, and transferring the visible image to a transfer member. The method may be an electrophotographic method. An electrophotographic process generally includes a charging process of uniformly charging an electrostatic latent image bearing member surface, an exposure process of using various photoconductive materials on the charged electrostatic latent image bearing member to form an electrostatic latent image, a developing process of attaching a developer such as toner, etc. to the latent image to develop a visible image, a transferring process of transferring the toner onto a visible image bearing member such as paper, a cleaning process of removing a residual toner which is not transferred, an erasing process of lowering electrical characteristics of a photoreceptor, and a fixing process of fixing the toner by heat and/or pressure. FIG. 2 is a schematic view of a non-contact development type apparatus for forming an image including toner according to an exemplary embodiment of the present general inventive concept.

A non-magnetic one-component developer, i.e., toner 208, in a developing device 204 is supplied to a developing roller 205 by a supply roller 206 formed of an elastic material, such as polyurethane foam or sponge. The toner 208 supplied onto the developing roller 205 reaches a contact portion between a developer-regulating blade 207 and the developing roller 205 as the developing roller 205 rotates. The developer-regulating blade 207 may be formed of an elastic material, such as metal or rubber. When toner 208 passes through the contact portion between the developer-regulating blade 207 and the developing roller 205, the amount of toner 208 may be regulated to be a thin layer of a uniform thickness, and may also be sufficiently charged. The toner 208 which has been formed into a thin layer is transferred to a development region of a photoreceptor 201 where a latent image on the surface of the photoreceptor 201 is developed with the toner supplied by the developing roller 205, wherein the photoreceptor 201 is an example of an image carrier. As previously described, the electrostatic latent image is formed by scanning light 203 onto the photoreceptor 201.

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction, whereas the photoreceptor 201 may rotate in a clockwise direction.

According to an exemplary embodiment, toner 208, which has been transferred to the development region of the photoreceptor 201, develops the latent image formed on the photoreceptor 201 into a toner image using an electrostatic force generated due to the potential difference between a direct current (DC)-biased alternating current (AC) voltage applied to the developing roller 205 and the latent potential of the photoreceptor 201 charged by a charging unit 202.

The toner image, which has been developed on the photoreceptor 201, reaches a transfer unit 209 as the photoreceptor 201 rotates. The toner image, which has been developed on the photoreceptor 201, is transferred to a print medium 213 when the print medium 213 is passed between the photoreceptor 201 and the transfer unit 209 by the transfer unit 209 having a roller shape and to which a high voltage having a polarity opposite to toner 208 is applied.

The toner image transferred to the print medium 213 passes through a high-temperature, high-pressure fusing device (not shown), and thus is fused to the print medium 213, thereby resulting in a fixed image. The non-developed, residual developer 208' on the developing roller 205 is collected by the supply roller 206 contacting the developing roller 205 whereas the non-developed, residual developer 208' on the photoreceptor 201 is collected by a cleaning blade 210. The processes described above may be repeated for the formation of subsequent images.

The present general inventive concept will be described below in more detail with reference to following Examples and Comparative Examples. However, the present general inventive concept is not limited thereto.

Example 1

100 parts by weight of a styrene-butyl acrylate-acrylic acid copolymer resin dispersion (copolymerization ratio=82:18:2, weight-average molecular weight: 23,000, glass transition temperature=65° C., average particle diameter: 200 nm, solid content: 40 wt %), 12 parts by weight of a cyan pigment dispersion (solid content: 20 wt %), and 0.6 parts by weight of a cationic surfactant were mixed, and aggregation-coalescence of the mixture was performed by a typical polymerization method, to prepare cyan toner particles (average particle diameter: about 6.2 μm).

100 parts by weight of the dry cyan toner particles were put into an external adder (2 L). Subsequently, at the amounts described in Table 1 below: sol-gel silica particles having an average primary particle diameter of about 70 nm and an apparent density of about 220 g/L; fumed silica particles having an average primary particle size of about 10 nm and an apparent density of about 140 g/L, which were surface-treated with hexamethyl disilane (HMDS), and had a charge amount, which is an entrained amount of charge measured using ferrite particles, in a range of about 0 to about −400 μC/; and rutile-type titanium dioxide particles having an average primary particle diameter of about 40 nm and hydrophobically-treated with polydimethylsilane (PDMS), were put into the external adder (2 L), and then mixed at 2000 rpm for 30 seconds and stirring at 6000 rpm for another 3 minutes to prepare externally added toner particles.

TABLE 1

Combinations of external additives

| | Sol-gel silica particles | Fumed silica particles | Titanium dioxide particles |
|---|---|---|---|
| Example 1 | 70 nm, No treatment, 1.2 parts by weight* | 1 part by weight | 0.5 part by weight |
| Example 2 | 70 nm, DMDES 5 wt %**, 1.2 parts by weight | 1 part by weight | 0.5 part by weight |
| Example 3 | 70 nm, DMDES 10 wt %, 1.2 parts by weight | 1 part by weight | 0.5 part by weight |
| Example 4 | 70 nm, DMDES 15 wt %, 1.2 parts by weight | 1 part by weight | 0.5 part by weight |
| Comparative Example 1 | 150 nm, No treatment, 1.2 parts by weight | 1 part by weight | 0.5 part by weight |
| Comparative Example 2 | 150 nm, DMDES 5 wt %, 1.2 parts by weight | 1 part by weight | 0.5 part by weight |
| Comparative Example 3 | 150 nm, DMDES 10 wt %, 1.2 parts by weight | 1 part by weight | 0.5 part by weight |
| Comparative Example 4 | 40 nm, fumed silica***, 1.2 parts by weight | 1 part by weight | 0.5 part by weight |

*Based on 100 parts by weight of resin.

**DMDES: Dimethyldiethyl silane, and wt % is based on the weight of the silica by a sol-gel method.

***Fumed silica having an average primary particle diameter of about 40 nm and not subjected to any treatment is used instead of sol-gel silica.

The sphericity distributions of the sol-gel silica particles having an average primary particle diameter of about 70 nm in Examples 1 to 4, and the sol-gel silica particles having an average primary particle diameter of about 150 nm in Comparative Examples 1 to 3, are shown in Table 2 below.

TABLE 2

Sphericity distributions of sol-gel silica particles

| Range of sphericity values | Percentage of the sol-gel silica particles in Example 1 to 4 | Percentage of the sol-gel silica particles in Comparative Examples 1 to 3 |
|---|---|---|
| $0.75 \le a < 0.8$ | 2% | 0% |
| $0.8 \le b < 0.85$ | 4% | 0% |
| $0.85 \le c < 0.9$ | 11% | 0% |
| $0.9 \le d < 0.95$ | 44% | 5% |
| $0.95 \le e < 1.0$ | 40% | 95% |

In Examples 1 to 4, the percentage of the sphericity values (shortest diameter/longest diameter) of the sol-gel silica particles in a range of about 0.95 or more, was only about 40%, indicating that the sphericity is low. On the other hand, in Comparative Examples 1 to 3, the percentage of the sphericity values of the sol-gel silica particles in a range of about 0.95 or more, is about 95%, indicating that the sphericity is high. In Table 2, the percentage of the sol-gel silica particles in each sphericity value range is a value calculated by magnifying and observing the sol-gel silica particles at 50,000× through scanning electron microscopy (SEM), and analyzing the shortest and longest diameters from 100 of the sol-gel silica particles, using an image analyzer.

The particle size distributions of the sol-gel silica particles having an average primary particle diameter of about 70 nm in Examples 1 to 4, and the sol-gel silica particles having an average primary particle diameter of about 150 nm in Comparative Examples 1 to 3, are shown in Table 3 below.

TABLE 3

Particle size distributions of sol-gel silica particles

| Size distribution | Sol-gel silica particles in Example 1 to 4 | Sol-gel silica particles in Comparative Examples 1 to 3 |
|---|---|---|
| D10v | 0.0183 | 0.03 |
| D16v | 0.0217 | 0.035 |
| D50v | 0.041 | 0.057 |
| D84v | 0.08 | 0.098 |
| D90v | 0.097 | 0.112 |
| $(D84/D16)^{1/2}$ | 1.92 | 1.67 |

The particle size distribution values in Table 3 are measured by using Microtrac from Honeywell Corp. Referring to Table 3, the volume average particle size distribution value, $GSDv=(D84v/D16v)^{1/2}$, of the sol-gel silica particles in Examples 1 to 4 is about 1.92, indicating that the particle size distribution is relatively wide. In Table 3, for example, D16v and D84v respectively indicate a particle diameter at which a cumulative percentage of 16% is attained, and a particle diameter at which a cumulative percentage of 84% is attained, in a cumulative distribution of volume of silica particles measured by a Coulter method. On the other hand, the volume average particle size distribution value (GSDv) of the sol-gel silica particles in Comparative Examples 1 to 3 is about 1.67, indicating that the particle size distribution is relatively narrow. When the particle size distribution is wide as in Examples 1 to 4, external additives may be relatively uniformly attached to a toner particle surface layer to enhance the charge uniformity.

Example 2

Toner particles were prepared in the same manner as Example 1, except that sol-gel silica particles surface-treated with 5 wt % of DMDES were used.

Example 3

Toner particles were prepared in the same manner as Example 1, except that sol-gel silica particles surface-treated with 10 wt % of DMDES were used.

Example 4

Toner particles were prepared in the same manner as Example 1, except that sol-gel silica particles surface-treated with 15 wt % of DMDES were used.

Comparative Example 1

Toner particles were prepared in the same manner as Example 1, except that sol-gel silica particles having an average primary particle diameter of about 150 nm were used instead of sol-gel silica particles having an average primary particle diameter of about 70 nm.

Comparative Example 2

Toner particles were prepared in the same manner as Example 1, except that sol-gel silica particles having an average primary particle diameter of about 150 nm and which were surface-treated with 5 wt % of DMDES were used instead of sol-gel silica particles having an average primary particle diameter of about 70 nm.

Comparative Example 3

Toner particles were prepared in the same manner Example 1, except that the sol-gel silica particles having an average primary particle diameter of about 150 nm and which were surface-treated with 10 wt % of DMDES were used instead of the sol-gel silica particles having an average primary particle diameter of about 70 nm.

Comparative Example 4

Toner particles were prepared in the same manner as Example 1 were prepared, except that the fumed silica particles having an average primary particle diameter of about 40 nm were used instead of the sol-gel silica particles having an average primary particle diameter of about 70 nm. That is, two types of fumed silica particles with different average particle diameters were used in the present Example without using the sol-gel silica particles.

Externally added toners in Examples 1 to 4 and Comparative Examples 1 to 4, obtained in the above-manner, were subjected to image evaluation by the following evaluation method, and the results are shown in Table 4 below.

<Image Evaluation Method of Toners>

In order to evaluate the characteristics of toner particles prepared in Examples 1 to 4 and Comparative Examples 1 to 4, tests were performed in the following manner.

First, the cohesiveness was measured for evaluation of the fluidity of the obtained toners. The image evaluation was performed by using the toners with a commercially available non-magnetic monocomponent development printer (tandem type, 20 ppm, CLP 770 printer from Samsung Electronics Co., Ltd) composed of a non-contact type development apparatus, to print up to 5,000 sheets at 1% coverage and thus, measuring the developability, transferability, image concentration, image contamination, and variations over time (variations in toner layers and image concentration on a developing roller according to the number of sheets to be printed). The results are shown in Table 4 below.

Cohesiveness (Toner Fluidity)

Equipment: Hosokawa micron powder tester PT-S

Amount of sample: 2 g

Amplitude: 1 mm dial 3~3.5

Sieve: 53, 45, 38 μm

Vibration time: 120±0.1 seconds.

After the samples were stored at room temperature and RH of 55±5% for 2 hours, the samples were sieved under the above conditions to calculate the toner cohesiveness as follows.

[(mass of powders remaining on 53 μm sieve)/2 g]×100

[(mass of powders remaining on 45 μm sieve)/2 g]×100×(3/5)

[(mass of powders remaining on 38 μm sieve)/2 g]×100×(1/5)

Degree of cohesiveness (Carr's cohesion)=(1)+(2)+(3)

Standard of Cohesiveness Evaluation

◎: Vastly superior fluidity, having a degree of cohesiveness of less than 10

○: Satisfactory fluidity, having a degree of cohesiveness of 10 or more to less than 15

Δ: Inferior fluidity, having a degree of cohesiveness of 15 or more to less than 20

X: Vastly inferior fluidity, having a degree of cohesiveness of 20 or more

Developability

An image of a predetermined area was developed on an electrophotographic photoreceptor before toners were transferred from the photoreceptor to an intermediate transfer member. Then the weight of toner per unit area of the electrophotographic photoreceptor was measured by using a suction apparatus to which a filter is attached. The weight of toner per unit area on a developing roller was simultaneously measured to evaluate the developability as follows.

Development efficiency=Weight of toner per unit area of electrophotographic photoreceptor/Weight of toner per unit area of developing roller.

Standard of Developability Evaluation

◎: Development efficiency of 90% or more

○: Development efficiency of 80% or more to less than 90%

Δ: Development efficiency of 70% or more to less than 80%

X: Development efficiency of 60% or more to less than 70%

Transferability (Primary and Secondary)

Through evaluation of the developability, a primary transferability was evaluated by using a ratio of a weight of toner per unit area of the electrophotographic photoreceptor and a weight of toner per unit area of an intermediate transfer member after the toner was transferred from the electrographic photoreceptor to the intermediate transfer body. In addition, a secondary transferability was evaluated using a ratio of a weight of toner per unit area of the intermediate transfer member and a weight of toner per unit area on paper after the toner was transferred to the paper. The transferability was evaluated by using an unfixed image which had not been fixed to measure a weight of toner per unit area on the paper.

Primary transfer efficiency=Weight of toner per unit area on intermediate transfer member/Weight of toner per unit area of electrophotographic photoreceptor, Secondary transfer efficiency=Weight of toner per unit area on paper/Weight of toner per unit area of intermediate transfer member, Transfer efficiency=Primary transfer efficiency−Secondary transfer efficiency.

Standard of Transferability Evaluation

◎: Transfer efficiency of 90% or more

○: Transfer efficiency of 80% or more to less than 90%

Δ: Transfer efficiency of 70% or more to less than 80%

X: Transfer efficiency of 60% or more to less than 70%

Image Concentration

Four-point positions of a solid area image were set, and the initial image density was determined at each position to confirm the average. The image concentration was measured by using a reflection densitometer from Electroeye. The measurement results were classified according to the following standard.

◎: Image having an image density of 1.3 or more

○: Image having an image density of 1.2 or more to less than 1.3

Δ: Image having an image density of 1.1 or more to less than 1.2

X: Image having an image density of less than 1.1.

Image Contamination

The image contamination was measured based on the extent of a background contamination, i.e., the so-called fog phenomenon, an image contamination according to a charge roller contamination, streaks, etc., according to a prolonged image output.

◎: No image contamination

○: Slight image contamination

Δ: High image contamination

X: Very high image contamination

Variations Over Time

When 5,000 sheets were printed, a weight of toner per unit area on a developing roller was measured to evaluate a degree of variation relative to the initial phase, as the number of sheets to be printed increased. The measurement results were classified according to the following standard.

◎: A weight of toner per unit area of a developing roller after printing 5,000 sheets was increased less than 10% relative to that of the initial phase ○: A weight of toner per unit area of a developing roller at 5,000 sheets was increased 10% or more to less than 20% relative to that of the initial phase Δ: A weight of toner per unit area of a developing roller at 5,000 sheets was increased 20% or more to less than 30% relative to that of the initial phase X: A weight of toner per unit area of a developing roller at 5,000 sheets was increased 40% or more relative to that of the initial phase.

Here, the initial phase means a state after printing 10 sheets.

TABLE 4

Results of image evaluation

| | Fluidity | Developability | Transferability | Image concentration | Image contamination | Variations over time | Total |
|---|---|---|---|---|---|---|---|
| Example 1 | ◎ | ○ | ○ | ○ | ○ | ○ | ○ |
| Example 2 | ◎ | ◎ | ◎ | ◎ | ◎ | ◎ | ◎ |
| Example 3 | ○ | ◎ | ◎ | ◎ | ◎ | ◎ | ◎ |
| Example 4 | X | ○ | ○ | ○ | ○ | ○ | Δ |

TABLE 4-continued

| | Results of image evaluation | | | | | | |
|---|---|---|---|---|---|---|---|
| | Fluidity | Developability | Transferability | Image concentration | Image contamination | Variations over time | Total |
| Comparative Example 1 | ○ | ○ | ○ | ○ | X | X | Δ |
| Comparative Example 2 | ◎ | ◎ | ◎ | ○ | X | X | ○ |
| Comparative Example 3 | ○ | ◎ | ◎ | ○ | X | X | ○ |
| Comparative Example 4 | Δ | Δ | Δ | Δ | ○ | ○ | Δ |

Referring to Table 4, toners in Examples 1 to 4, according to the present general inventive concept, are excellent in terms of all characteristics, such as fluidity, developability, transferability, image concentration, etc., while toners in Comparative Examples 1 to 3 are very poor, particularly with regard to variations over time and image contamination.

According to various embodiments, provided is a toner including hydrophobically surface-treated fumed silica particles, hydrophobically surface-treated titanium dioxide particles, and sol-gel silica particles, having appropriate particle diameters, a low sphericity, and a wide average particle size distribution, as an external additive.

According to various embodiments, provided is a toner that maintains charge uniformity, fluidity, transfer efficiency, and cleanability over a long period of time. For this reason, a durable, high quality image lacking image defects may be stably obtained over a long period of time. In addition, because the toner may have high charge stability, according to changes in the environment in the non-magnetic mono-component non-contact development mode, and may maintain an appropriate charge amount at high speed, the background contamination is low, relatively small amounts of materials are fused and attached to a cleaning blade, and the transfer efficiency and image uniformity is high. In particular, the fluidity is good and thus, the conveyance of toner is good. Even if the toner is stored over a long-period of time, the low blocking phenomenon is observed, indicating that the toner is excellent in terms of storage stability.

Although a few exemplary embodiments of the present general inventive concept have been shown and described, it will be appreciated by those skilled in the art that changes may be made in these exemplary embodiments, without departing from the principles and spirit of the general inventive concept, the scope of which is defined in the appended claims and their equivalents.

What is claimed is:

1. A toner for developing an electrostatic charge image, the toner comprising:

a toner particle comprising a binder resin, a colorant, and a releasing agent; and an external additive disposed on the surface of the toner particle, the external additive comprising:

sol-gel silica particles having an average sphericity value in a range of from about 0.8 to about 0.97, a Braunauer-Emmett-Teller (BET) specific surface area of about 30 $m^2/g$ to about 70 $m^2/g$, and an average primary particle diameter in a range of from about 10 nm to less than 80 nm, wherein the sphericity value is a ratio between a shortest diameter and a longest diameter of each of the sol-gel particles and a ratio of the number of sol-gel silica particles having a sphericity value of less than about 0.97 to the total number of the sol-gel silica particles is at least about 50%;

hydrophobically surface-treated fumed silica particles having average primary particle diameters in a range of from about 7 nm to about 50 nm; and hydrophobically surface-treated titanium dioxide particles having average primary particle diameters in a range of from about 10 nm to about 50 nm, wherein a $(D84v/D16v)^{1/2}$ value of the sol-gel silica particles is in a range of from about 1.7 to about 2.3, in which D16v is a particle diameter at which a cumulative percentage of 16% is attained, and D84v is a particle diameter at which a cumulative percentage of 84% is attained, in a cumulative volume distribution of the sol-gel silica particles as measured by the Coulter method.

2. The toner of claim 1, wherein the external additive comprises about 0.1 parts by weight to about 3 parts by weight of the sol-gel silica particles, about 0.1 parts by weight to about 2 parts by weight of the fumed silica particles, and about 0.1 parts by weight to about 2 parts by weight of the titanium dioxide particles, based on 100 parts by weight of the toner particle.

3. The toner of claim 1, wherein the sol-gel silica particles have a BET specific surface area in a range of from about 30 $m^2/g$ to about 70 $m^2/g$, and a degree of hydrophobicity of less than about 50.

4. The toner of claim 1, wherein the sol-gel silica particles have a true specific gravity in a range of from about 1.5 to about 2.5.

5. The toner of claim 1, wherein a sphericity and an average particle diameter of the sol-gel silica particles are calculated by measuring the longest diameters, the shortest diameters, and the average particle diameters of 100 of the sol-gel silica particles at room temperature and under a relative humidity (RH) of 55±5%.

6. The toner of claim 1, wherein the toner comprises a secondary particle comprising an aggregation of the hydrophobically surface-treated fumed silica particles, the secondary particle having an average particle diameter in a range of from about 5 μm to about 20 μm and a bimodal-type particle size distribution with two peaks at about 1 μm or less and about 5 μm or more.

7. The toner of claim 1, wherein the toner particles are prepared by a pulverization method or by a polymerization method.

8. A method for forming an image, the method comprising:

attaching a toner to an electrostatic latent image formed on a photoreceptor to form a visible image; and transferring the visible image to a transfer member, wherein the toner comprises:

a toner particle comprising a binder resin, a colorant, and a releasing agent; and an external additive disposed on the surface of the toner particle, the external additive comprising:

sol-gel silica particles having an average sphericity value in a range of from about 0.8 to about 0.97, a Braunauer-Emmett-Teller (BET) specific surface area of about 30 $m^2/g$ to about 70 $m^2/g$, and an average primary particle diameter in a range of from about 10 nm to less than 80 nm, wherein the sphericity value is a ratio between a shortest diameter and a longest diameter of each of the sol-gel particles and a ratio of the number of sol-gel silica particles having a sphericity value of less than about 0.97 to the total number of the sol-gel silica particles is at least about 50%;

hydrophobically surface-treated fumed silica particles having average primary particle diameters in a range of from about 7 nm to about 50 nm; and hydrophobically surface-treated titanium dioxide particles having average primary particle diameters in a range of from about 10 nm to about 50 nm, wherein a $(D84v/D16v)^{1/2}$ value of the sol-gel silica particles is in a range of from about 1.7 to about 2.3, in which D16v is a particle diameter at which a cumulative percentage of 16% is attained, and D84v is a particle diameter at which a cumulative percentage of 84% is attained, in a cumulative volume distribution of the sol-gel silica particles as measured by the Coulter method.

9. The method of claim 8, wherein the external additive comprises about 0.1 parts by weight to about 3 parts by weight of the sol-gel silica particles, about 0.1 parts by weight to about 2 parts by weight of the fumed silica particles, and about 0.1 parts by weight to about 2 parts by weight of the titanium dioxide particles, based on 100 parts by weight of the toner particle.

10. A toner for developing an electrostatic charge image, the toner comprising:

a toner particle;

sol-gel silica particles disposed on the toner particle and having an average sphericity value in a range of from about 0.8 to about 0.97, a Braunauer-Emmett-Teller (BET) specific surface area of about 30 $m^2/g$ to about 70 $m^2/g$, and an average primary particle diameter in a range of from about 10 nm to less than 80 nm, wherein the sphericity value is a ratio between a shortest diameter and a longest diameter of each of the sol-gel particles and a ratio of the number of sol-gel silica particles having a sphericity value of less than about 0.97 to the total number of the sol-gel silica particles is at least about 50%;

hydrophobically surface-treated fumed silica particles having average primary particle diameters in a range of from about 7 nm to about 50 nm disposed on the toner particle and in gaps between the sol-gel particles; and hydrophobically surface-treated titanium dioxide particles having average primary particle diameters in a range of from about 10 nm to about 50 nm disposed on the toner particle, wherein a $(D84v/D16v)^{1/2}$ value of the sol-gel silica particles is in a range of from about 1.7 to about 2.3, in which D16v is a particle diameter at which a cumulative percentage of 16% is attained, and D84v is a particle diameter at which a cumulative percentage of 84% is attained, in a cumulative volume distribution of the sol-gel silica particles as measured by the Coulter method.

* * * * *